United States Patent [19]

Pennington-Richards

[11] Patent Number: 4,624,019

[45] Date of Patent: Nov. 25, 1986

[54] APPARATUS FOR HELPING A PERSON TO GET IN OR OUT OF A BATH

[76] Inventor: Cyril M. Pennington-Richards, 1 Tithe Barn Close, Aldwick Bay, Bognor Regis, West Sussex, United Kingdom

[21] Appl. No.: 674,412

[22] Filed: Nov. 23, 1984

Related U.S. Application Data

[63] Continuation-in-part of Ser. No. 612,261, May 21, 1984, abandoned.

[51] Int. Cl.[4] ..... A47K 3/12

[52] U.S. Cl. ..... 4/566; 4/562

[58] Field of Search ..... 4/496, 560–566; 5/81 R, 81 B

[56] References Cited

U.S. PATENT DOCUMENTS

| | | | |
|---|---|---|---|
| 2,624,053 | 1/1953 | Beckwith | 4/565 |
| 2,680,855 | 6/1954 | Robinson | 4/562 |
| 2,697,475 | 12/1954 | Deuth | 4/566 |
| 3,188,657 | 6/1965 | Cotner | 4/562 |
| 3,280,409 | 10/1966 | Cotner | 4/563 |
| 3,981,484 | 9/1976 | James | 4/564 |

FOREIGN PATENT DOCUMENTS

| | | |
|---|---|---|
| 744155 | 2/1956 | United Kingdom . |
| 957599 | 5/1962 | United Kingdom . |

*Primary Examiner*—Charles E. Phillips

*Attorney, Agent, or Firm*—Pravel, Gambrell, Hewitt & Kimball

[57] ABSTRACT

Apparatus for helping a person to get in or out of a bathtub which comprises a seat mounted at the lower end of a carrier which is suspended at its upper end from the upper end of the push rod of a hydraulic jack having its cylinder fixed vertically in position adjacent the end of the bathtub. The push rod is extended to lift the carrier by supplying water under pressure, preferably from the water main, to the cylinder under the control of a valve, the push rod being guided vertically and restrained laterally by a pair of fixed vertical guide channels in which run wheels mounted at the end of a cross bar fixed to the upper end of the push rod. The upper end of the carrier simply hooks over the cross bar, and when the push rod is fully extended the carrier hangs from the cross bar with wheels mounted at the back of the carrier at its lower end resting against and restrained by an anchor plate fixed in position above the upper edge of the bathtub. When the cylinder is exhausted, the push rod retracts so that the seat is lowered into the bathtub, the wheels running off the plate and down the inside of the bathtub until the seat reaches the bottom. Any change in inclination of the carrier caused by the wheels following the contour of the bathtub is accommodated by the upper end pivoting about the horizontal axis of the cross bar.

A second example is described in which the seat carrier is also rotatable about the vertical axis of the lifting jack when the seat is in a raised position above upper edge of the bathtub.

20 Claims, 10 Drawing Figures

54
6
59
52
53
55
64
51
112
110
114
116
83
20
62
76
77
81
58
57
11
10
1
12
9

APPARATUS FOR HELPING A PERSON TO GET IN OR OUT OF A BATH

This application is a continuation-in-part of my copending application Ser. No. 612,261 filed May 21, 1984 now abandoned.

BACKGROUND OF THE INVENTION

There are an enormous number of people who, for one reason or another, have a problem getting in and out of a bathtub because they find it difficult to get down to the sitting position and often even more difficult to get back up again. This difficulty, coupled with the slippery conditions in the bathtub, makes the operation extremely hazardous and, indeed, a great many accidents occur every year as a result.

With the aim of alleviating this problem, there have been prior devices and apparatus designed to help a person get in or out of a bathtub, and the present invention relates generally to such apparatus of the type comprising a hydraulic jack arranged to be anchored firmly in an upright position adjacent the bathtub, and a seat mounted on a carrier which is arranged to be raised and lowered in the bath by extension and retraction of the jack.

DESCRIPTION OF THE PRIOR ART

In a known apparatus of this type the cylinder of the jack is fixed and the carrier is connected to the upper end of the push rod by the jack by a horizontal arm so that the seat carrier is supported in a cantilever fashion, and the arm can be pivoted about the vertical axis of the jack to swing the carrier and its seat towards and away from the bathtub when they are fully raised. However, because of the cantilevered support of the seat carrier, the centre of gravity of the apparatus, particularly during use, is considerably displaced from the axis of the jack, and the apparatus must be constructed and fitted in position sufficiently robustly to cater for this. Also, the apparatus takes up a large amount of space in the bathroom, which can be inconvenient, particularly if the room is not very big and is sometimes used by other persons who have no need to use the apparatus.

SUMMARY OF THE INVENTION

According to this invention, apparatus for helping a person to get in and out of a bathtub comprises a hydraulic jack mounted firmly in an upright position adjacent the bath and arranged to be extended and/or retracted by a valve controlled supply of fluid under pressure, either the push rod or the cylinder of the jack moving axially between raised and lowered positions when the jack is extended and retracted, fixed means for guiding and laterally supporting the axially moving member of the jack during extension and retraction, and a seat mounted at the lower end of a carrier which is connected at its upper end to the axially movable member of the jack so that the seat is raised and lowered in the bathtub with the raising and lowering of the movable member of the jack, and so that the carrier is able to pivot about a horizontal axis to allow the lower end of the carrier to contact and follow the contour of the inside of the bath as the seat is raised and lowered.

With this arrangement the carrier is effectively suspended directly from the movable member of the jack, and the centre of gravity of the apparatus is relatively close to the axis of the jack. Also, since the lower end of the carrier is arranged to contact and follow the inside of the bathtub during raising and lowering of the seat, a portion of the weight suspended from the jack is transmitted to, and thereby borne by, the bathtub. Consequently, the apparatus may be constructed in a much more compact manner and from lighter weight materials than the known apparatus.

Usually it will be most convenient to position the apparatus adjacent the end of the bathtub opposite the water valves or taps. If there is floor space adjacent the end of the bathtub, the fixed guide and support means may be anchored to the floor and/or possibly to the bathtub, and preferably the cylinder of the jack will be fixed thereto with the push rod projecting from its upper end and the carrier pivotally connected to the upper end of the push rod. If there is no floor space adjacent the end of the bathtub, the fixed guide and support means may, if possible, be anchored to the wall above the end of the bathtub, or alternatively the apparatus may be positioned at the side of the bathtub. If the guide and support means is fixed to the wall above the bathtub, it may be more convenient to invert the jack and arrange for the cylinder to move, the carrier then being pivotally connected to the lower end of the cylinder.

Also, it will usually be most convenient to operate the jack using water as the driving fluid, since there will usually be a ready supply of water under sufficient pressure available from the mains. A cylinder having an internal diameter of 3 inches (7.62 cms) in conjunction with a main water pressure of 60 psi (4.22 kg/sq.cm.) will give the apparatus a lifting capacity of up to 424 lbs. (192.5 kgs), which is more than sufficient to lift most people with ease. Using the main water pressure to power the jack also has the advantage that the apparatus needs no electrical power for its operation, which is an important safety factor in a bathroom. However, in situations where the main water is not available or is generally at very low pressure, water at sufficient pressure may be supplied by means of a small electrical pump.

Preferably the hydraulic jack is single acting, and its control valve is arranged to connect the cylinder to the supply of water under pressure to raise the seat, and to connect the cylinder to discharge to the sewer or waste to allow the seat to lower under the action of gravity. The speed at which the seat is lowered is determined by the minimum bore size of the passage through which the water is discharged from the cylinder to the sewer or waste, and obviously this will be chosen so that the seat is lowered very gently. Preferably the control valve also has an off position in which the cylinder is neither connected to the supply of water under pressure nor to waste. The valve may be mounted permanently in a convenient position, for example on a wall adjacent the side of the bathtub, which allows the valve to be reached easily by a person sitting on the seat whether in the raised or lowered position. Alternatively, the valve may be movable to suit the user, in which case its connection to the water supply and to the cylinder will of course be flexible.

In operation, a person wishing to use the apparatus to get down into a bathtub first operates the control valve to raise the seat to a position where the person can comfortably sit on it from a standing position adjacent the bathtub. This position may be controlled by turning the valve to its off position to stop the seat where desired, but usually the position will be preset by suitably limiting the extension of the jack, for example by means of stops on the fixed guide and support means engageable by the movable member of the jack, a cable activated pressure shut off means or in the case of a single acting jack by means of an automatic stop such as an overflow port in the cylinder wall. The person then sits on the seat and switches the valve to lower the seat to the bottom of the bathtub. The person may then either slide off the seat onto the bottom of the bathtub, or may bathe while remaining sitting on the seat. Preferably the seat and the carrier are arranged so that the person is lowered as close as possible to the bottom of the bathtub. When the person wishes to get out, the valve is switched to the lifting position and the supply of fluid under pressure to the cylinder gently lifts the seat together with the person sitting on it to the raised position, whereupon the person is able to move easily from the seat to a standing position. The person then simply has to step out of the bath in the normal way.

As will be understood, when the seat is raised and lowered the lower end of the carrier will ride on the inside wall of the bath, the upper end of the carrier pivoting about its connection to the jack to accommodate any change in the angle of the carrier to the vertical, and preferably therefore the carrier is provided with suitable low friction means, such as wheels or a roller, for enabling the lower end of the carrier to ride easily over the inside surface of the bathtub without causing damage to the surface. If desired, however, the apparatus may include a flexible sheet, preferably removable, for covering and protecting the inside surface of the bathtub followed by the lower end of the carrier when the seat is raised and lowered. Furthermore, this sheet may be provided with tracks for guiding the lower end of the carrier as it is moved up and down.

It will also be understood that since the inner walls of a bathtub are generally not vertical but instead slope downwardly and inwardly towards the bottom of the bathtub, particularly at the end which is opposite the water valves or taps for the bathtub and at which the apparatus will preferably be situated, the angle of the carrier to the vertical will vary as its lower end follows the contour of the inside of the bathtub during raising and lower of the seat. Consequently, the seat is preferably angled obliquely to the back of the carrier so that the surface of the seat is substantially horizontal when the seat is fully lowered at the bottom of the bathtub. As a result, when the seat is fully raised and the back of the carrier is closer to the vertical, the seat is inclined slightly downwards and away from the back of the carrier, which in fact makes it easier for a person to get on and off the seat, particularly if, as is preferred, the seat is lifted higher than the height of a normal chair seat.

In this base, the seat will usually be raised higher than the bathtub, and preferably the apparatus includes a stabilizing plate attached to the fixed guide and support means adjacent the top edge of the bathtub, and the lower end of the carrier which follows the contour of the bathtub when the seat is raised and lowered engages the surface of the stabilizing plate when the seat is fully raised, the stabilizing plate having guides which engage the carrier to hold the seat firmly in position when the seat is fully raised.

As will be appreciated, the apparatus so far described requires the user to be able to climb into and out of the bath, but for persons who have difficulty with this as well as with sitting down and getting up in the bathtub, apparatus in accordance with the invention may also be construed in which the seat carrier is rotatable about the vertical axis of the jack when fully raised, thus allowing a user to sit on the raised seat outside the bathtub, to swing over the edge of the bathtub, lower into the bath, and to get out in the reverse manner. For this purpose, the carrier and the seat must be wholly above the top edge of the bathtub when in the raised position, and the upper end of the carrier must be connected to the movable member of the jack in a manner which permits rotation about the axis of the jack as well as the horizontal axis when fully raised and without fouling the fixed guide and support means. Also, when as is preferred, the apparatus is provided with a stabilizing plate which engages and holds steady the lower end of the carrier in the raised position, the stabilizing plate must be mounted for rotation about the axis of the jack.

An important preferred feature of the present invention is that the pivotal connection of the upper end of the carrier to the axially movable member of the jack should allow the carrier to be readily detached from and re-attached to the movable member, a suitable form of connection being provided by arranging the carrier simply to hook onto the movable member. In this way, when the apparatus is not in use the carrier and seat can be disconnected from the rest of the apparatus and conveniently stored out of the way, thus leaving the bathtub and bathroom to be used normally with very little interference from the fixed part of the apparatus.

Two examples of the apparatus in accordance with the invention will now be described with reference to the accompanying drawings.

DESCRIPTION OF THE PREFERRED EMBODIMENT

Figure 1:
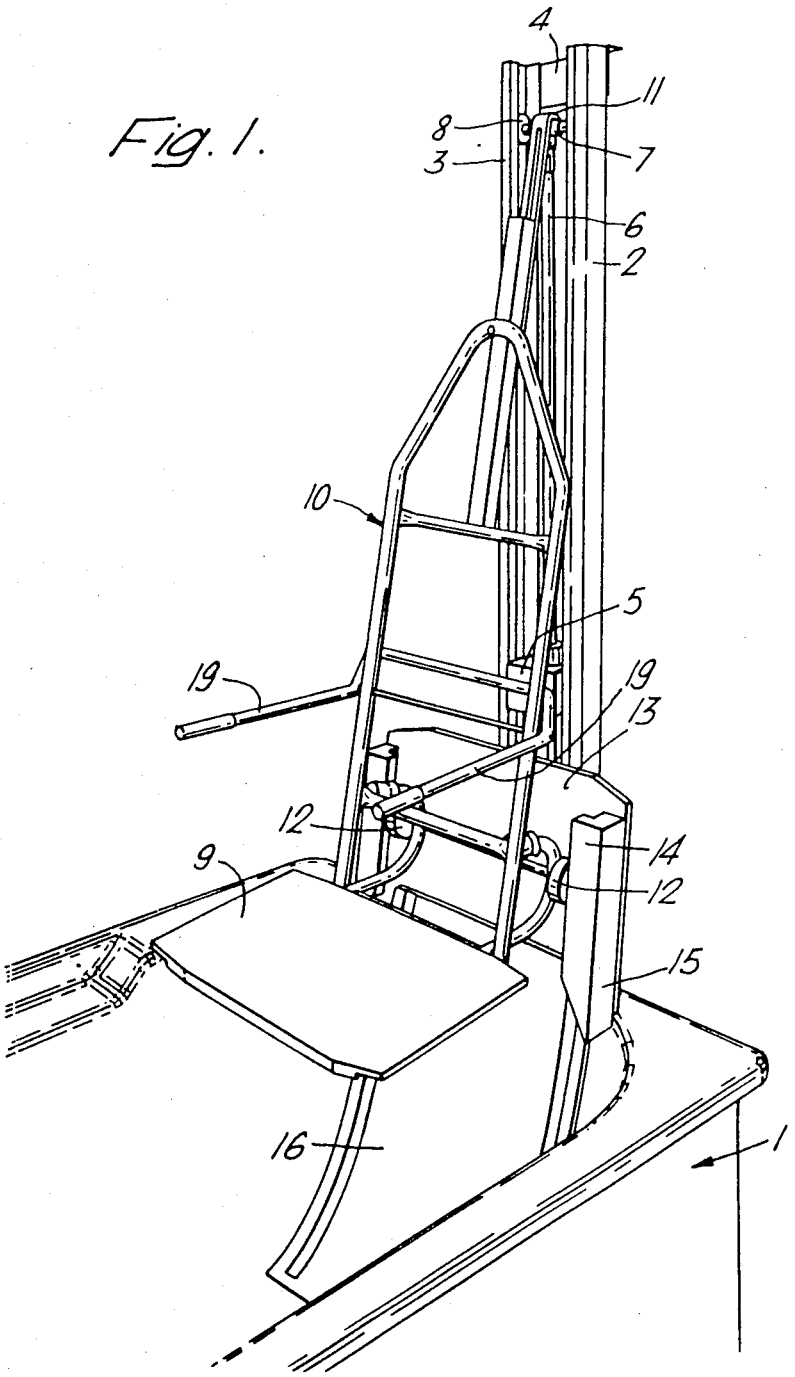
FIG. 1 is a perspective view from the front of the preferred embodiment showing the seat fully raised and ready for operation.
Figure 2:
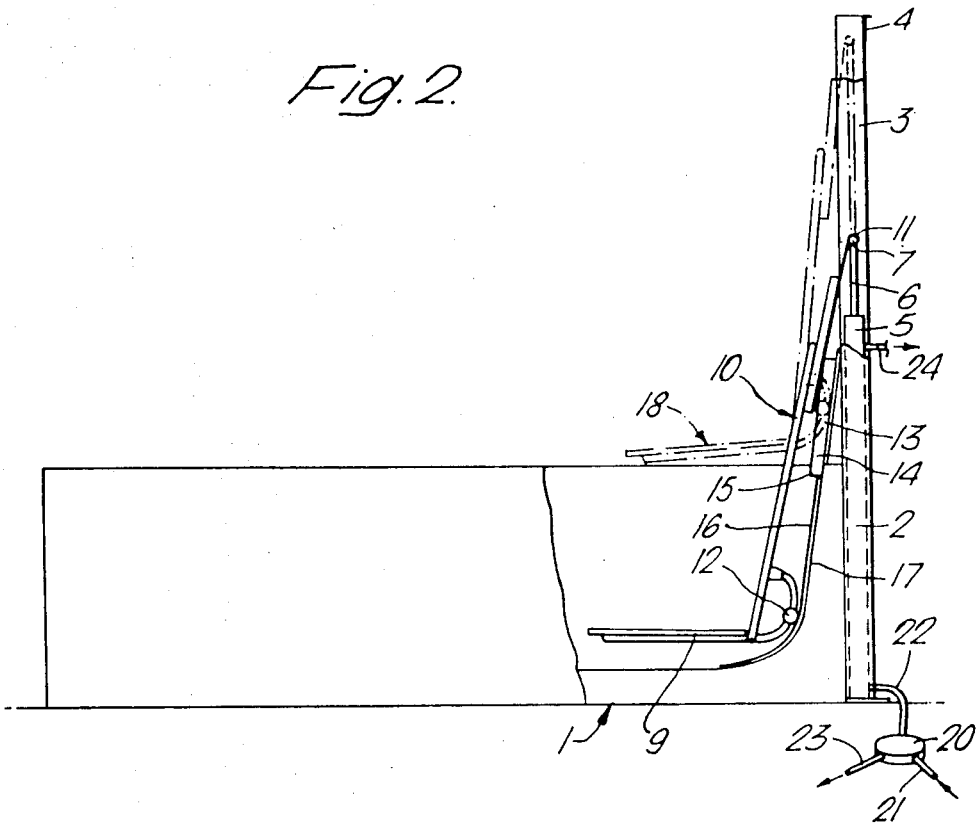
FIG. 2 is a side view of the embodiment of FIG. 1 illustrating both the fully raised (dash-dot lines) and fully lowered (solid lines) positions of the seat during operation.

The apparatus shown in FIGS. 1 and 2 is mounted adjacent the end of the bathtub 1 remote from the taps. The apparatus has a pair of upright channel members 2 and 3 which are fixed at their lower ends to the floor adjacent the end of the bathtub 1 so that they stand vertically with their channels facing each other, and which are fixed relative to each other at their upper ends by a cross plate 4 welded to the rear edges of the members. Fixed vertically between the lower halves of the channel members 2 and 3 is the cylinder 5 of a hydraulic jack having its push rod 6 projecting from the upper end of the cylinder. The free or upper end of the push rod 6 has fixed to it a horizontal crossbar 7 carrying at opposite ends a pair of wheels 8 which are rotatable about the axis of the crossbar 7 and are received in the channels of the two channel members 2 and 3. The channel members thereby guide and support the free end of the push rod 6 during extension and retraction of the jack, so that the push rod moves freely in a vertical direction but is restrained from lateral displacement as a result of lateral forces exerted on the push rod during operation of the apparatus.

The apparatus also comprises a seat 9 fixed to the lower end of a carrier 10 which is suspended at its upper end from the crossbar 7 at the upper end of the push rod 6 so that the seat is located over the bathtub. The upper end of the carrier 10 has an overturned portion 11 which simply hooks over the crossbar 7 to suspend the carrier so that it can pivot about the horizontal axis of the bar 7. The seat 9 projects forwards from the carrier 10 at its lower end, and at the rear of the carrier, behind the seat, the carrier is provided with a pair of wheels 12 through which the lower end of the carrier rests, depending on the position of the push rod 6, against either the inside rear wall of the bath 1 or a stabilizing anchor plate 13 mounted adjacent the upper rear edge of the bathtub. The wheels 12 are rotatably mounted on stub axles (not shown) which project outwards from the wheels and, when the carrier is resting against the anchor plate 13, engage under a pair of parallel guide strips 14 fixed to the plate 13 for locating and holding the carrier 10 (and hence the seat 9) laterally in position on the plate. The lower end portions 15 of the guide strips 14 project below the lower edge of the anchor plate 13 and engage over the inner edge of the bathtub to locate the plate 13 so that its surface is substantially in line with the inside surface of the rear end of the bathtub. The anchor plate 13 is firmly attached to the fixed upright channel members 2 and 3, for example by being bolted to brackets welded to the outsides of the channel members, and the engagement of the lower ends 15 of the guide strips 14 over the inner edge of the bathtub thereby also serves to hold the fixed guide and support means formed by the channel members 2 and 3 braced against the end of the bath.

In FIG. 1 the apparatus is shown with the push rod 6 fully extended and the seat carrier 10 therefore in its fully raised position with its lower end resting against the anchor plate 13. Retracting the push rod 6 will lower the carrier 10 so that the wheels 12 will run off the surface of the plate 13 and down the inside of the surface of the plate 13 and down the inside of the bathtub at its rear end until the push rod is fully retracted and/or the seat is at the bottom of the bathtub as shown in FIG. 2. In order to avoid damaging the surface of the bathtub the apparatus may include a flexible protective sheet, as shown at 16, which is detachably connected to the lower edge of the anchor plate 13 so that it extends down into the bathtub over the surface followed by the wheels 12. The sheet 16 should be sufficiently rigid to resist wrinkling as the wheels 12 run over it. Preferably the surface of the sheet 16 is provided with parallel ribs or grooves for engaging and guiding the wheels 12 to ensure that the seat is raised and lowered without any side to side movement. Because the surface of a bathtub at the rear end usually slopes downwards and forwards, for example as illustrated at 17 in FIG. 2, the lower end of the carrier 10, in following the contour 17, will move away from the vertical plane defined by the channel member 2 and 3 when the seat is lowered in the bathtub and vice versa, and the hooked upper end 11 of the carrier will accordingly pivot about the horizontal axis of the crossbar 7.

As shown in FIG. 2, the seat 9 is angled obliquely to the carrier 10 so that the seat projects substantially horizontally when the carrier is fully lowered and the seat is adjacent the bottom of the bathtub. Preferably the seat is arranged on the carrier 10 so that it will contact the bottom of the bathtub when fully lowered, and preferably the underside of the seat is arranged to match the profile of the bottom of the bathtub so that the seat can get as low as possible into the bathtub. For this purpose the seat may be rigid with a suitable shaped profile, or it may be in the form of a flexible sling. When the seat is raised however, the contour 17 of the bathtub allows the lower end of the carrier 10 closer to the vertical, and as a result the seat 9 projects slightly downwards away from the carrier, as shown by the dotted line 18 in FIG. 2 indicating the fully raised position of the seat and carrier.

The carrier is also provided with a pair of arm rests 19 for the user of the apparatus when sitting on the seat 9. The arm rests 19 are pivotally mounted on the carrier 10 so that they can be swung from the operative position upwards to an inoperative position (not shown) lying alongside the back of the carrier 10.

The hydraulic jack 5, 6 which operates to lower and raise the seat 9 into and out of the bathtub is controlled by means of a control valve 20, and this will be located in a position where it can be operated conveniently by the user of the apparatus. For example, the valve 20 may be permanently fixed to a wall adjacent the side of the bathtub, or it may be detachable mounted on the side of the bath or on one of the arms 19 of the carrier 10. The valve 20 has three positions, a first "on" position in which a pipe 21 carrying water at water mains pressure is connected to a pipe 22 leading to the lower end of the cylinder 5, whereby the cylinder is pressurized to extend the push rod 6 and raise the seat 9; a second "on" position in which the pipe 22 is connected to a pipe 23 leading to waste, whereby water is able to discharge from the cylinder 5 to allow the push rod 6 to retract and the seat 9 to lower under the force of gravity; and an off position in which all three pipes 21, 22 and 23 connected to the valve are closed. When the valve 20 is in its first "on" position the push rod 6, and with it the carrier 10 and the seat 9, will rise until the piston at the lower end of the push rod in the cylinder uncovers an overflow port 24 near the upper end of the cylinder. At this point, water under pressure will escape through the port 24, being conducted either to waste or into the bathtub, and further extension of the push rod 6 is prevented. The position of this overflow port 24 therefore determines the fully raised position of the seat 9. When the valve 20 is turned on the second "on" position the push rod 6 retracts and the seat is lowered into the bath until it comes to rest on the bottom. When the seat comes to rest in either the fully raised or fully lowered position the valve 20 is turned to the off position, and the seat then remains in the raised or lowered position until the valve is turned to the relevant "on" position which will move the seat.

When the apparatus does not need to be used, the carrier 10 (and with it the seat) can be detached and removed from the rest of the apparatus by operating the valve 20 to lower the seat into the bathtub and then simply unhooking the upper end 11 of the carrier from the upper end of the push rod 6. The carrier and seat can then be lifted out of the bathtub and stored in a convenient place out of the way. In addition, the mat 16 can be detached from the lower edge of the anchor plate 13 and also removed from the bathtub. As will be appreciated, the remaining permanently positioned parts of the apparatus will present minimal interference to normal usage of the bathtub and bathroom.

Figure 3:
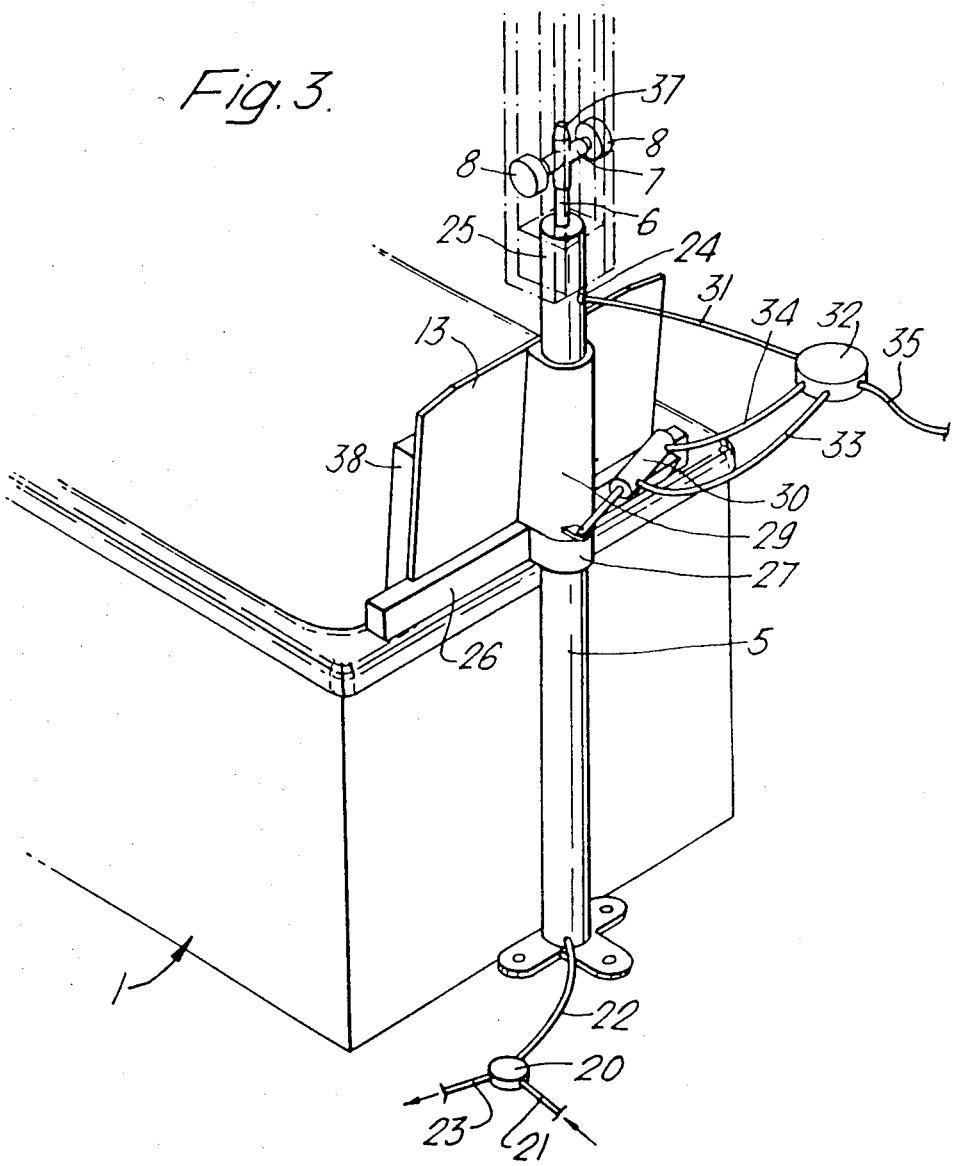
FIG. 3 is a perspective view from the rear of a second embodiment example in an inoperative condition with the seat removed.
Figures 4, 4A:
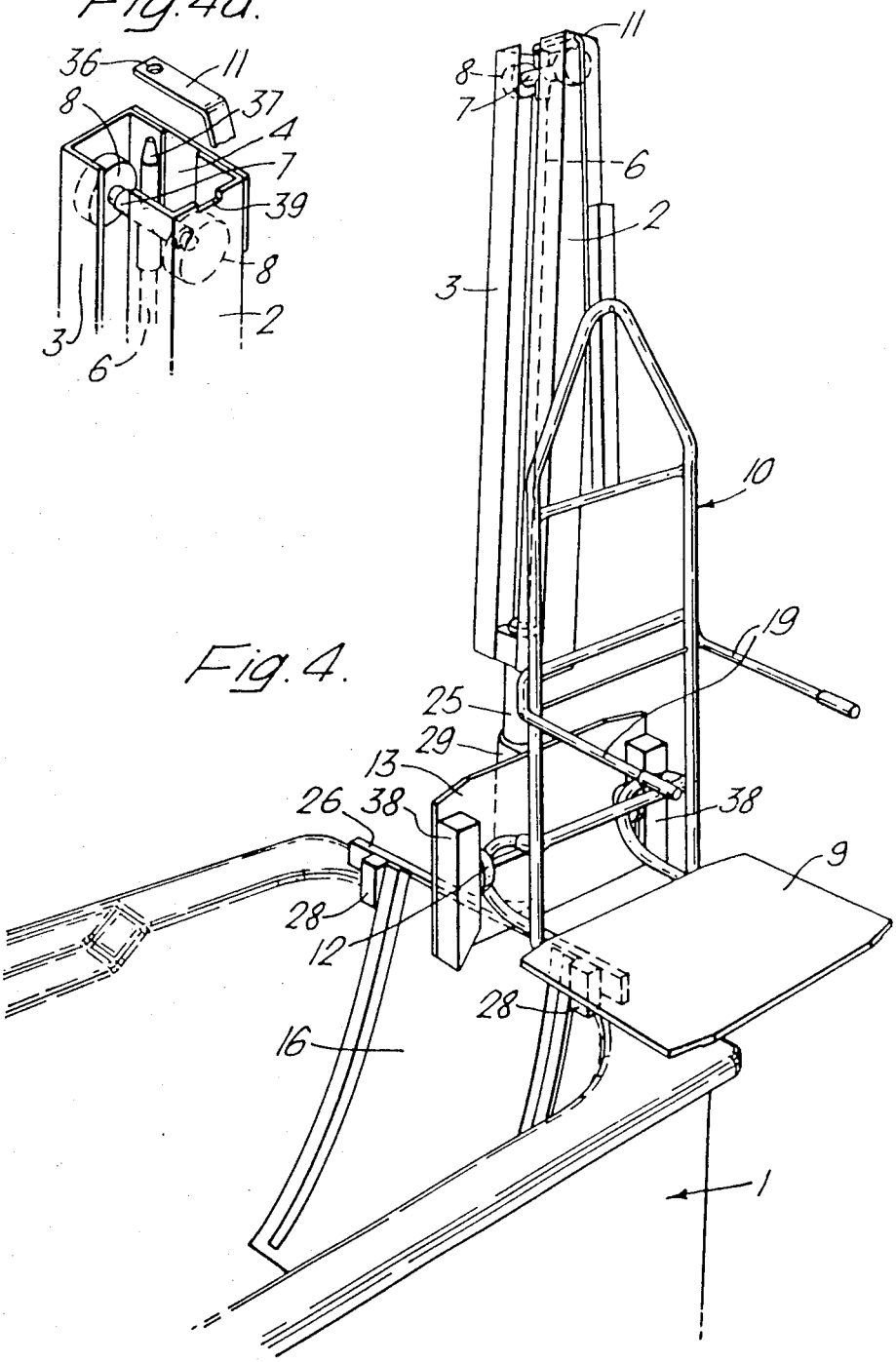
FIG. 4 is a perspective view from the front of the second embodiment showing the seat in position for receiving a person adjacent for the bathtub.
FIG. 4*a* is an isometric view, partly exploded, of the top of the apparatus shown in FIG. 4.

In the second embodiment illustrated in FIGS. 3 and 4, the apparatus is similar to that in the first example (corresponding parts have the same reference numerals) except for various modifications which allow the seat 9 not only to be lowered and raised into and out of the bathtub when facing forwards over the bathtub, but also to swing between the position in which the seat faces forwards over the bathtub and a position in which the seat is outside the bathtub (as shown in FIG. 4) when the seat is fully raised.

In the second embodiment, the cylinder 5 of the lifting jack is itself fixed at its lower end to the floor adjacent the end of the bathtub 1, and the channelled guide members 2 and 3 for the upper end of the push rod 6 are fixed to and project vertically upwards from the upper end 25 of the cylinder. At the upper edge of the bathtub 1 the cylinder 5 is braced firmly against the bath by means of an anchor bar 26 which is fixed to a fixed collar 27 on the cylinder 5 so that the bar 26 rests on the top edge of the bathtub and a pair of locating and retaining lugs 28 project downwards from the front of the bar 26 over the inner edge of the bathtub.

As in the first embodiment, the second embodiment comprises a stabilizing anchor plate 13 for receiving and holding steady the lower end of the carrier 10 when the seat 9 is fully raised. In this case however, the anchor plate 13 is located adjacent the upper edge of the anchor bar 26 and is fixed to a collar 29 which is rotatable on the cylinder 5 between the fixed collar 27 and the upper end 25 to which the channel members 2 and 3 are fixed. The collar 29, and with it the anchor plate 13, is arranged to be rotated between the positions shown in FIGS. 3 and 4 by means of a double acting hydraulic jack 30 having its cylinder attached to the fixed anchor bar 26 and its push rod attached to the collar 29. The push rod 6 of the lifting jack 5, 6 is raised and lowered in exactly the same way as in the first embodiment, and the turning jack 30 is arranged to be operated by the water under pressure which escapes from the overflow port 24 at the upper end of the cylinder 5 when the valve 20 is in its first "on" position and the push rod 6 is fully extended. For this purpose the overflow port 24 is connected by a pipe 31 to a second control valve 32 which can be operated to connect the pipe 31 to either of two pipes 33 and 34 leading to opposite ends of the cylinder of the jack 30 and at the same time to connect the other of the two pipes 33 and 34 to a pipe 35 leading to waste. Consequently, when the first control valve 20 is turned on and the push rod 6 is fully extended, depending on the position of the second control valve 32, the anchor plate 13 will either remain where it is or it will be rotated automatically about the axis of the cylinder 5 to its other rotary position (FIG. 3 or FIG. 4).

The seat 9 and carrier 10 of the second embodiment are identical to those of the first embodiment except at the upper end of the carrier where the over turned portion 11 is horizontal and has a hole 36 arranged to fit over a slightly tapered spigot 37 projecting upwards from the crossbar 7 at the upper end of the push rod 6. This form of hook connection will permit the carrier 10 to pivot a certain amount about the horizontal axis of the crossbar 7 when the seat is facing forwards over the bathtub, and will also allow the carrier to rotate about the axis of the push rod 6 when the push rod is fully extended. As shown in FIGS. 4 and 4*a*, in this position the spigot 37 projects above the upper ends of the channel members 2 and 3 while the guide wheels 8 are retained within the channels of the members 2 and 3.

As in the first embodiment, when the seat 9 is fully raised, the outwardly projecting stub axles of the wheels 12 at the lower end of the carrier 10 engage under parallel guide strips 38 mounted on the front face of the anchor plate 13. In contrast to the guide strips 14 of the first example, however, the guide strips 38 are slidably mounted on the plate 13 and are spring biassed in a downward direction so that the lower ends of the strips 38 are urged to project below the lower edge of the plate 13. Consequently, when the plate 13 is facing towards the bathtub as shown in FIG. 3 and the seat is either removed from the apparatus or is in its lowered position, the lower ends of the guide strips 38 project downwards over the front of the anchor bar 26 to locate and hold the plate 13 firmly in position. When the seat is fully raised however, the stub axles of the wheels 12 engage stops within the guide strips 38 so as to retract the strips 38 against their spring bias so that the lower ends of the strips are raised above the lower edge of the plate 13 and the plate is free to rotate.

When the plate 13 has been rotated to swing the carrier and the seat outwards from the bathtub to the position shown in FIG. 4, and the first control valve 20 is turned off, the push rod 6 retracts very slightly until the piston just covers the overflow port 24. This lowers the seat very slightly, and the over turned portion 11 at the upper end of the carrier 10, which now projects outwards over the upper end of the channel member 2, is received in a notch 39 in the top of the channel member, thus helping to hold the seat steady in this position while the user of the apparatus gets onto or off the seat. When the seat is to be swung back to project over the bathtub, the second control valve 32 is turned to the appropriate position and the first control valve 20 is again turned to its first "on" position to supply mains pressure to the cylinder 5. This slightly raises the piston to uncover the overflow port 24, thus raising the upper end of the carrier 11 out of the notch 39, and the water escaping from the overflow port 24 operates the jack 30 to rotate the plate 13 back to the position shown in FIG. 3, wherein the seat is supported over the bathtub ready to be lowered into the bathtub by switching the first control valve 20 to its second "on" position.

Figures 5, 6:
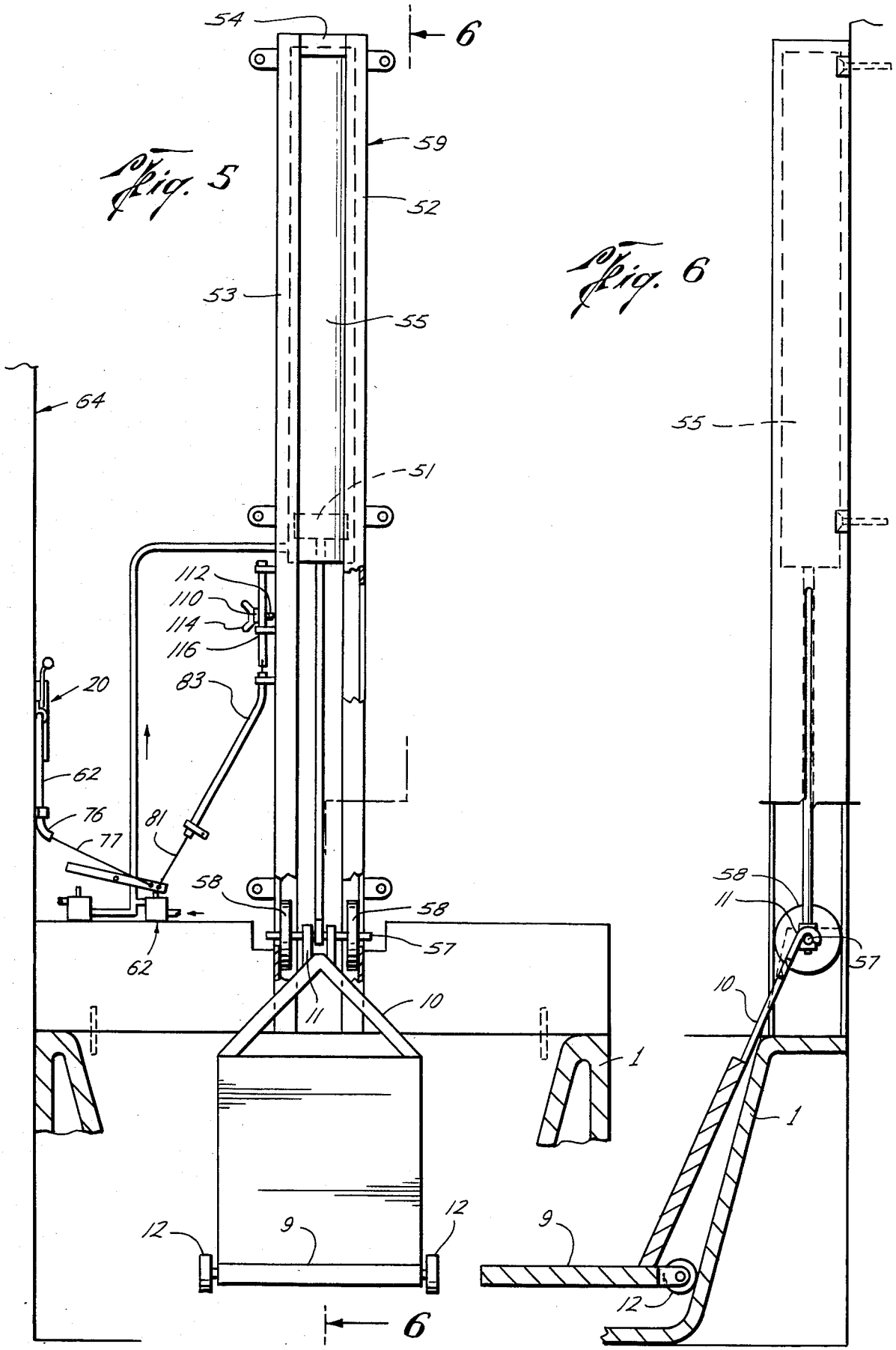
FIG. 5 is a front view of a third embodiment of the apparatus which is a wall mounted unit with the seat shown in a lowered position in the bathtub.
FIG. 6 is a side view partially in cross-section along line 6—6 of FIG. 5.

FIG. 5 shows a third embodiment of the present invention having the cylinder 55 and channel members 52 and 53 attached to or recessed into the wall adjacent the end of the bathtub. Channel members 52 and 53 are mounted with their channels facing each other and are fixed relative to each other at their upper ends by cross plate 54. Cylinder 55 is fixed vertically between the upper halves of channel members 53 and 54. Cylinder 55 is a single acting inverted cylinder wherein fluid pressure below piston 51 will raise piston 51 into cylinder 55 and cause pushrod 56 to be pulled upward. A crossbar 57 is mounted to the lower end of pushrod 56.

Seat 9 is fixed to the lower end of carrier 10 and suspended at its upper end from crossbar 57. The upper end of carrier 10 has an overturned portion 11 which simply hooks over crossbar 57 to suspend the carrier 10 so that it can pivot about the horizontal axis of crossbar 57. Seat 9 and carrier 10 include wheels 12 as discussed hereinabove.

Figure 7:
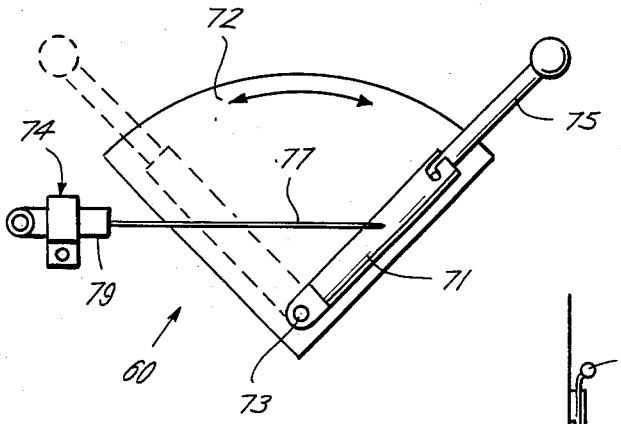
FIG. 7 is a front view of the valve control of FIG. 5.

FIG. 5 includes a schematic representation of the preferred control valve 20 and valve means 62 of the present invention. Control valve unit 20 is adapted for mounting in a convenient location such as on a wall 64 adjacent the bathtub 1. Valve control unit 60 (see FIG. 7) includes lever 71 which pivots about pivot pin 73. Lever 71 is retained within valve control body 72 by pivot pin 73 and includes a handle 75 designed to be easily grasped.

Control valve 20 is connected to valve actuator 90 more fully described hereinbelow through a bowden cable 62. Bowden cable 62 includes an inner wire cable 77 attached to lever 71 at one end and to control bar 91 at its other end. Outer outer casing 79 for wire cable 77 which is fixed at one end to valve control body 72 at 74 and fixed at its other end 76 to a wall 64 adjacent the valve actuator 90. The bowden cable allows for a flexible yet direct interconnection between control lever 71 and valve actuator 90. Movement of control lever 71 is transmitted through inner cable 77 to valve actuator 90.

Valve actuator 90 comprises a control bar 91 pivotally mounted above valves 93 and 94. Valves 93 and 94 comprise upper chamber **93*a* and 94*a* and lower chamber 93*b* and 94*b*. Chambers 93*a* and 93*b* and chambers 94*a* and 94*b* are interconnected by openings 95 and 96 respectively. Openings 95 and 96 are sealed by valve balls 97 held in position by springs 98. By applying pressure to valve balls 95 or 96 through plungers 99 or 100 which extend through upper chambers 93*a* and 94*a*, openings 95 and 96 allow fluid interconnection of the upper and lower chambers of valves 93 and 94 respectively. Lower chamber 94*b* includes a pressurized water inlet 101 connected to the household water supply (not shown). Upper chamber 93*a* of valve 93 includes a waste water outlet 102. Lower chamber 93*b* and upper chamber 94*a* are interconnected by suitable tubing 103. Tubing 103 includes a "T" fitting 104 leading to cylinder 55 below piston 51**.

Figure 8:
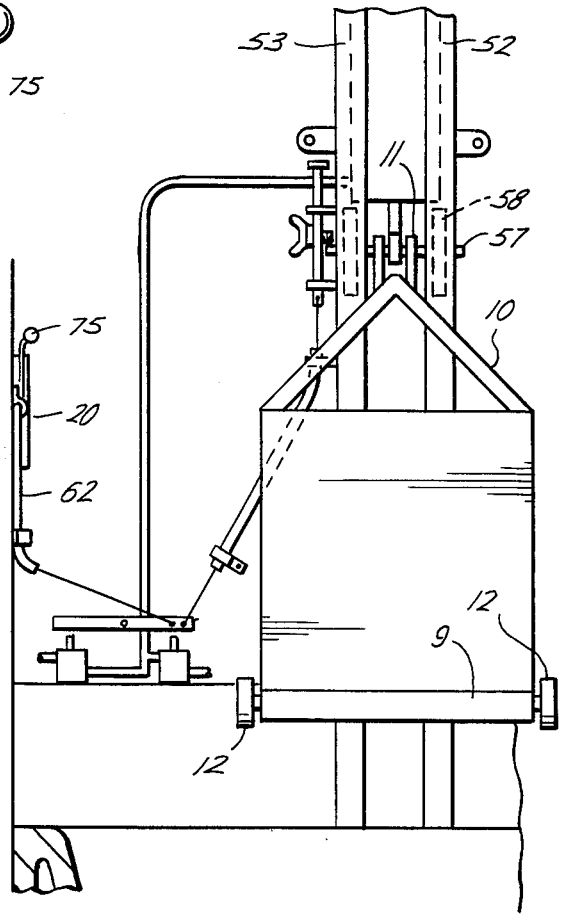
FIG. 8 is a partial front view of the apparatus of FIG. 5, with the seat in a raised position.

The valve control (shown in FIGS. 5, 8 and 9) further includes a bowden cable auto shutoff which will shut off the inlet of pressurized water to cylinder 55 when crossbar 57 reaches a predetermined position on track 59. The auto shutoff includes an inner cable 81 and an outer casing 83. The inner cable is connected to valve control bar 91 at one end and to adjustable sliding stop 110 at its other end. Casing 83 is connected to a wall adjacent valve actuator 90 at one end and to track 59 at its other end. Movement of sliding stop 110 will pivot control bar 91 about pivot point 92.

Sliding stop 110 comprises a stop 112 adjustably attached to inner cable 81 by wing nut 114 or other suitable means. Sliding stop 110 is slidably located on guide 116 mounted to the outside of channel member 53. The movement of sliding stop 110 by contact with crossbar 57 will force stop 112 upward pulling cable 81 and thereby pivoting control 91 to the stop position (shown in FIG. 8). Crossbar 57 extends outside tract 53 through a slot (not shown) a sufficient distance such that it will contact stop 112 when the piston 51 is fully within cylinder 55 thereby placing seat 9 in its fully raised position.

FIG. 5 shows control bar 91, stop 110 and valve control 60 in the "raise" position whereby water under pressure will flow into valve 94 through Inlet 101, through orifice 56 while valve ball 97 is held down by piston 99, through outlet 102 and through "T" 104 into cylinder 55 below piston 51 thereby raising seat 9.

Figure 9:
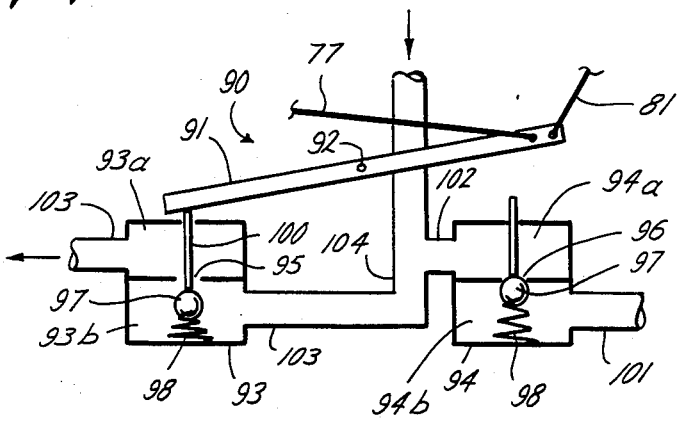
FIG. 9 is a front cross-sectional view of the control valve of FIGS. 5 and 8.

FIG. 9 shows an enlargement of the control valve 90 while the control bar 91 is in the "lower" position which allows water to flow out of cylinder 55 through valve 93 and out waste outlet 103 in order to lower seat 9 into the bathtub 1.

The foregoing disclosure and description of the invention are illustrative and explanatory thereof, and various changes in the size, shape and materials, as well as in the details of the illustrated construction may be made without departing from the spirit of the invention.

What is claimed is:

1. Apparatus for helping a person to get in or out of a bathtub, comprising:

a hydraulic jack mounted firmly in an upright position adjacent the bathtub and having a vertically movable member arranged to be vertically extended and retracted by a supply of fluid under pressure;

valve means to control the supply of fluid under pressure;

control means to actuate the valve means;

fixed guide and support means mounted firmly in an upright position adjacent the hydraulic jack for guiding and laterally supporting the vertically movable member of the jack during extension and retraction;

a substantially vertical carrier which is pivotally suspended by its upper end from the vertically movable member of the jack having a seat mounted at the lower end of the carrier, said lower end of the carrier further provided with a pair of wheels through which the carrier contacts and rides easily over the inside of the bathtub as the seat is raised and lowered, in the bathtub with raising and lowering of the moveable member of the jack;

a removable flexible sheet which covers and protects the inside surface of the bathtub followed by the lower end of the carrier when the seat is raised and lowered, the sheet being provided with tracks for guiding the wheels on the lower end of the carrier; and means to pivot the seat about the horizontal axis to allow the lower end of the carrier to contact and follow the contour of the inside of the bathtub as the seat is raised and lowered.

2. The apparatus of claim 1, wherein the hydraulic jack is floor mounted adjacent one end of the bathtub and the fixed guide and support means are secured to the bathtub in alignment with the hydraulic jack.

3. The apparatus of claim 1, wherein the hydraulic jack and the fixed guide and support means are secured to a wall adjacent one end of the bathtub.

4. Apparatus according to claim 1, in which the hydraulic jack is single acting, and the valve means is arranged to connect the cylinder to a supply of water under pressure to raise the seat, and to connect the cylinder to waste to lower the seat, the valve also having an off position in which the cylinder is neither connected to the supply of water under pressure nor to waste.

5. The apparatus according to claim 1, in which said control means comprises a lever adapted to be mounted remote from said valve means which actuates said valve means through a flexible means.

6. The apparatus according to claim 5, in which said control means further includes an automatic stop actuated by said jack as said seat is raised which activates said valve through a flexible means.

7. The apparatus of claim 1, wherein the hydraulic jack is single acting, and the valve means comprises a pair of interconnected bicompartment ball valves having:

an inlet from the supply of pressurized fluid;

an outlet to waste; and an intermediate interconnection to the hydraulic jack, whereby the ball valves can be operated so as to supply fluid under pressure to the hydraulic jack; release fluid from the hydraulic jack; and retain a desired volume of fluid in the hydraulic jack.

8. Apparatus according to claim 1, in which the cylinder of the jack is fixed and the push rod is vertically movable to raise and lower the seat.

9. Apparatus according to claim 1, in which the push rod of the jack is fixed and the cylinder is vertically movable to raise and lower the seat.

10. Apparatus according to claim 1, in which a stabilizing plate is attached to the fixed guide and support means adjacent the top edge of the bathtub, and the lower end of the carrier which follows the contour of the bathtub when the seat is raised and lowered engages the surface of the stabilizing plate when the seat is fully raised, the stabilizing plate having guides which engage the carrier to hold the seat firmly in position when the seat is fully raised.

11. Apparatus according to claim 10, in which the lower end of the carrier is provided with a pair of wheels through which the carrier contacts and rides easily over the inside of the bathtub as the seat is raised and lowered.

12. Apparatus according to claim 10, including a removable flexible sheet which covers and protects the inside surface of the bathtub followed by the lower end of the carrier when the seat is raised and lowered, the sheet being provided with tracks for guiding the wheels on the lower end of the carrier.

13. Apparatus according to claim 10, in which the guides on the stabilizing plate have portions which project downwards from the plate over the inner edge of the bathtub to help locate and hold the stabilizing plate in a position providing a substantially smooth transition between the inside of the bathtub and the surface of the plate.

14. Apparatus according to claim 1, in which the pivotal connection of the carrier to the vertically movable member of the jack allows the carrier to be readily detached from the movable member when the apparatus is not required to be used.

15. Apparatus according to claim 14, in which the carrier is simply hooked onto the movable member of the jack.

16. Apparatus according to claim 1, in which the seat is angled obliquely to the back of the carrier so that the surface of the seat is substantially horizontal when the seat is in the fully lowered position.

17. Apparatus according to claim 1, in which the underside of the seat is shaped to match the profile of the bottom of the bathtub so that the seat can reach as low as possible into the bathtub.

18. Apparatus according to claim 1, in which the carrier is provided with arm rests for a person sitting on the seat.

19. Apparatus according to claim 18, in which the arm rests are pivoted on the carrier so that they can be moved between operative and inoperative positions.

20. Apparatus according to claim 1, in which the fixed guide and support means comprises a pair of upright channel members which are fixed relative to each other with the channels facing each other, and the channels receive and guide wheels mounted on the vertically movable member of the jack.

* * * * *

UNITED STATES PATENT AND TRADEMARK OFFICE

CERTIFICATE OF CORRECTION

PATENT NO. : 4,624,019

DATED : November 25, 1986

INVENTOR(S) : Cyril M. Pennington-Richards

It is certified that error appears in the above-identified patent and that said Letters Patent is hereby corrected as shown below:

Column 3, line 55 - "base" should be "case".

Signed and Sealed this

Seventh Day of April, 1987

*Attest:*

DONALD J. QUIGG

*Attesting Officer*

*Commissioner of Patents and Trademarks*